US006439435B2

(12) United States Patent
Rosenberg

(10) Patent No.: US 6,439,435 B2
(45) **Date of Patent: *Aug. 27, 2002**

(54) DEVICE AND METHOD FOR DEODORIZING SHOES

(75) Inventor: Melvyn Rosenberg, Ramat Gan (IL)

(73) Assignee: Innoscent Ltd., Tel Hashomer (IL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/367,693

(22) PCT Filed: Feb. 10, 1998

(86) PCT No.: PCT/IL98/00080

§ 371 (c)(1),
(2), (4) Date: Aug. 19, 1999

(87) PCT Pub. No.: WO98/38881

PCT Pub. Date: Sep. 11, 1998

(30) Foreign Application Priority Data

Feb. 24, 1997 (IL) ..... 120306

(51) Int. Cl.[7] ..... B67D 5/64; B67D 5/06; B65D 88/54; B65D 83/00

(52) U.S. Cl. ..... 222/162; 251/185.1; 251/330; 251/402.19

(58) Field of Search ..... 222/162, 185.1, 222/394, 497, 173, 184, 174, 402.1, 402.19, 330

(56) References Cited

U.S. PATENT DOCUMENTS

| | | | | | |
|---|---|---|---|---|---|
| 2,821,048 | A | * | 1/1958 | Efford et al. | 222/174 |
| 3,964,647 | A | * | 6/1976 | Dearling | 222/174 |
| 4,335,837 | A | * | 6/1982 | Bono | 222/137 |
| 5,624,060 | A | * | 4/1997 | Ellion et al. | 222/376 |
| 5,799,835 | A | * | 9/1998 | Gobbel | 222/174 |

* cited by examiner

*Primary Examiner*—William C. Doerrler
*Assistant Examiner*—David Bonderer
(74) *Attorney, Agent, or Firm*—Baker Botts L.L.P.

(57) ABSTRACT

A deodorizer device for deodorizing shoes, includes a container containing deodorizer material, and a dispenser assembly at one end of the container for dispensing deodorizer material. The dispenser assembly includes a feed tube having one end located within the container and the opposite end communicating with one or more discharge openings for discharging deodorizer material laterally of the container. The dispenser assembly further includes an actuator attached at one end to the feed tube and configured to enable the actuator to be inserted into a shoe, when the container is inverted, to stably support the container in the inverted position, and to be pressed against the inner surface of the shoe bottom for discharging a quantity of deodorizer material from the discharge opening laterally into the shoe.

16 Claims, 2 Drawing Sheets

DEVICE AND METHOD FOR DEODORIZING SHOES

FIELD AND BACKGROUND OF THE INVENTION

The present invention relates to deodorizer devices and methods, and particularly to devices and methods for deodorizing shoes.

Shoe odor is a common problem. For this reason, it is generally recommended not to wear the same pair of shoes for extended periods of time in order to permit them to air out by themselves. However, this is not always possible or convenient. Therefore, dispensers have been developed for dispensing deodorizer materials directly into the shoes, but such dispensers dispense the deodorizer material from the top of the dispenser. This is somewhat awkward since the dispenser must be held by one hand and the shoe held by the other, and the user must manipulate the dispenser and/or the shoe in order to dispense the material within the shoe. Moreover, with the conventional shoe deodorant sprays, it is almost impossible to spray into the foot portion of high boots or high top sneakers.

OBJECTS AND BRIEF SUMMARY OF THE INVENTION

An object of the present invention is to provide a device and method having advantages in the above respects for deodorizing shoes.

According to one aspect of the present invention, there is provided a deodorizer device for deodorizing shoe, comprising: a container containing deodorizer material; and a dispenser assembly at one end of the container for dispensing deodorizer material therefrom; the dispenser assembly including a feed tube having one end located within the container and the opposite end communicating with at least one discharge opening externally of the container for discharging deodorizer material laterally of the container; the dispenser assembly further including an actuator attached at one end to the feed tube; the actuator being in the form of a cap having a socket at one end coaxial with, and dimensioned to receive, the opposite end of the feed tube, the opposite end of the cap being dimensioned and configured to enable the container to stably rest in the inverted position within the shoe with the one end of the container and the dispensing assembly disposed within the shoe, and the opposite end of the container extending outwardly of the shoe, to enable a quantity of the deodorizer material to be dispensed into the shoe by pressing against the opposite end of the container.

The present invention thus distinguishes from conventional shoe sprays, which have the dispensing valve located on the top of the container and are displayed in stores, kept by the consumer, and used by the consumer, in this upright position. A device constructed in accordance with this feature of the invention would have the dispensing valve located on the bottom of the container, and would be displayed, stored and used with the dispensing valve on the bottom. This means the package should be stable when standing in this inverted position. By having the package stable in this inverted position, the user can easily pick it up, place it directly into a shoe (without inverting it), and just press down to actuate the valve. With conventional shoe sprays the valve is actuated by a finger pressing against the actuator button, whereas in the novel device, the valve is actuated by the shoe pressing against the actuator.

According to a further aspect of the present invention, there is provided a method of deodorizing shoes, by providing a deodorizer device as described above; inserting the deodorizer device into a shoe, with the container in inverted position such that the actuator is at the bottom of the container; stably resting the container in this inverted position on the inner surface of the shoe bottom; and pressing downwardly the opposite end of the container for discharging a quantity of deodorizer material into the shoe.

The invention may be embodied in different types of dispensers. For example, the container may be of the type which contains a quantity of a deodorizer material pressurized by a gas propellant, in which case the dispenser assembly would include a normally-closed valve which is opened by the actuator when pressed against the inner surface of the shoe bottom to dispense a quantity of deodorizer material via the discharge opening laterally of the dispenser assembly and into the shoe. Another type is one wherein the container contains a quantity of an unpressurized deodorizer material (liquid or powder), and the dispenser assembly includes a manual pump which is pumped by the actuator when pressed against the inner surface of the shoe bottom to dispense a quantity of the deodorizer material via the discharge opening laterally of the dispenser assembly and into the shoe.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
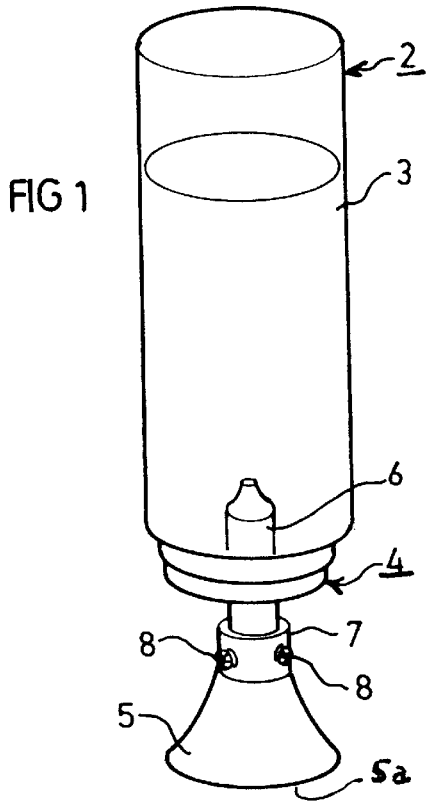
FIG. 1 illustrates one form of deodorizer device constructed in accordance with the present invention.
Figure 2:
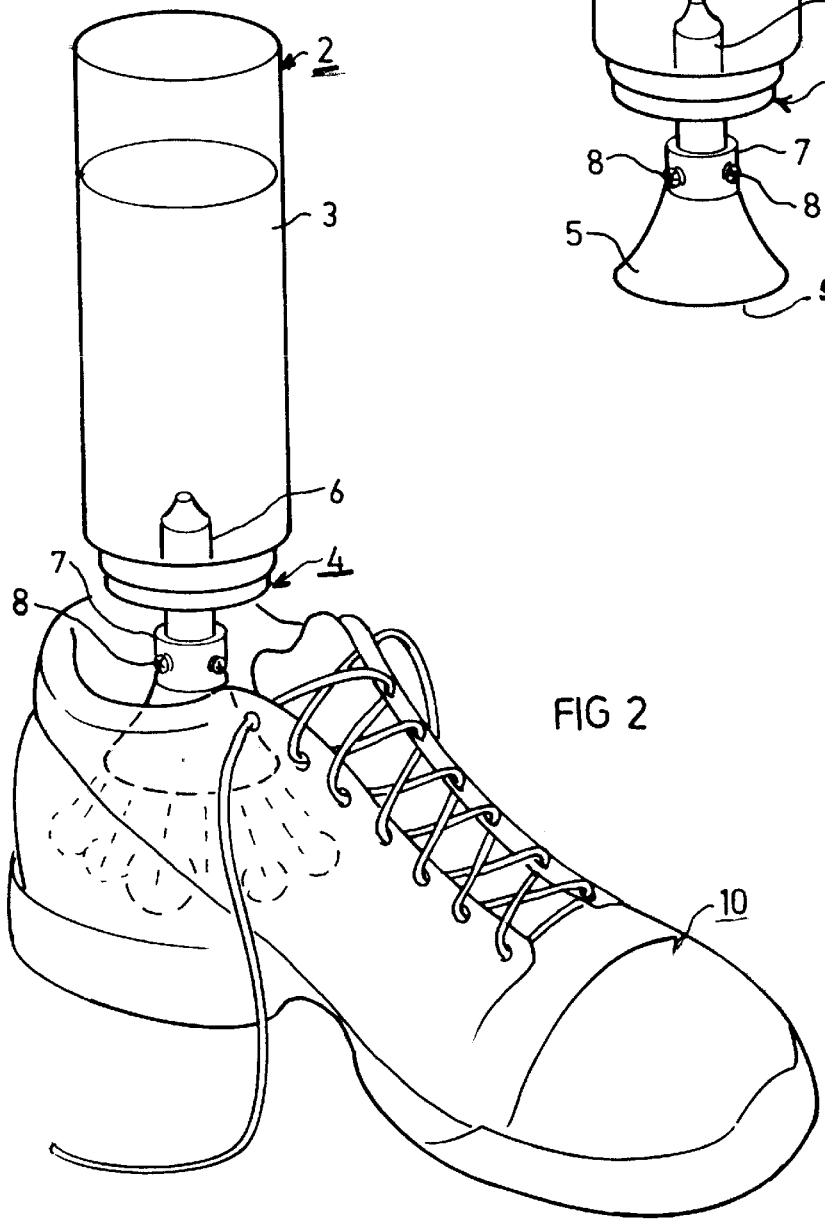
FIG. 2 illustrates the deodorizer device as applied to a shoe for deodorizing the shoe.

With reference to FIG. 1, there is illustrated a deodorizer device comprising a container 2 for containing a quantity of a liquid deodorizer material 3. A dispenser assembly, generally designated 4, is attached to the container 2 so as to be at the bottom of the container, rather than at the top as in a conventional dispenser of this type. Dispenser assembly 4 includes an actuator 5 in the form of a cap which is engageable with the inner surface of the bottom of the shoe, as illustrated in FIG. 2, for dispensing the deodorizer material 3. Dispenser assembly 4 further includes a feed tube 6 leading into the interior of container 2, and a socket 7 in the form of a collar formed at one end of cap 5. Socket 7 is coaxial with, and is dimensioned to receive, the external part of feed tube 6 and has one or more discharge openings 8 around its circumference. Each of the discharge openings 8 communicates via feed tube 6 with the interior of container 2.

As shown in FIG. 1, the opposite end 5*a* of actuator cap 5, which engages the inner surface of the shoe bottom as shown in FIG. 2, is of large cross-sectional area, the cross-sectional area of the actuator decreasing towards collar 7 formed with one or more discharge openings 8. Preferably, actuator cap 5 is of a generally conical configuration.

FIG. 2 illustrates the manner of using the deodorizer device for deodorizing a shoe, generally designated 10. Thus, the deodorizer device is inserted into the shoe, with the container 2 in the illustrated inverted position so that the actuator cap 5 is at the bottom of the container, and the outer surface of end 5*a* of the actuator cap 5 is pressed against the inner surface of the shoe bottom. This depression of the actuator cap 5 actuates the dispenser assembly 4 to discharge deodorizer material 3 via the discharge openings 8 around the circumference of the dispenser assembly 4 and in all directions into the interior of the shoe 10.

As one example, the container 2 could contain a quantity of liquid deodorizer material 3 pressurized by a gas propellant; and the dispenser assembly 4 could include a normally closed valve which is opened by actuator cap 5 when pressed against the shoe bottom to dispense a quantity of the deodorizer material 3 via the discharge openings 8 around the dispenser assembly 4 and in all directions into the interior of the shoe 10. Any known deodorizer material could be used, e.g., in the form of an anhydrous suspension, a suspension in water or some other liquid carrier, or dry powder.

As another example for implementing the invention, the container 2 could contain a quantity of an unpressurized liquid deodorizer material 3, and the dispenser assembly 4 could include a manual pump which is pumped by actuator cap 5 when pressed against the inner surface of the shoe bottom to dispense a quantity of the deodorizer material via the discharge openings 8.

The conical shape of actuator cap 5 provides a large surface area at its end 5*a* for engagement with the shoe bottom, and a relatively smaller annular area occupied by the discharge openings 8 for discharging the deodorizer material in all directions. In addition, this configuration of the actuator enables container 2 to stably rest in the inverted position within the shoe. It will be appreciated, however, that the actuator cap 5 may take other configurations.

Following is one example of a deodorizer material formulation that can be used:

| | |
|---|---|
| ethanol | 70% |
| water | 23.0% |
| preventol R80 | 3.2% |
| NP10 | 2% |
| orange terpenes | 1.0% |
| pine oil | 0.5% |
| perfume | 0.15% |
| citric acid | 0.1% |
| EDTA | 0.05% |

Figure 3:
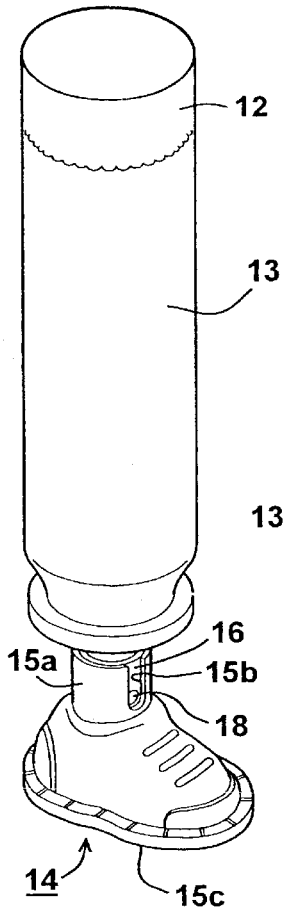
FIGS. 3, 4 and 5 are perspective, front and side views respectively, of another deodorizer device constructed in accordance with the present invention.
Figure 4:
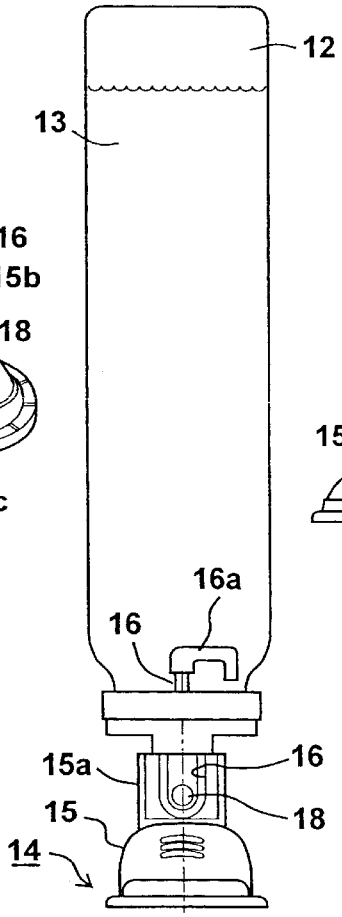
Figure 5:
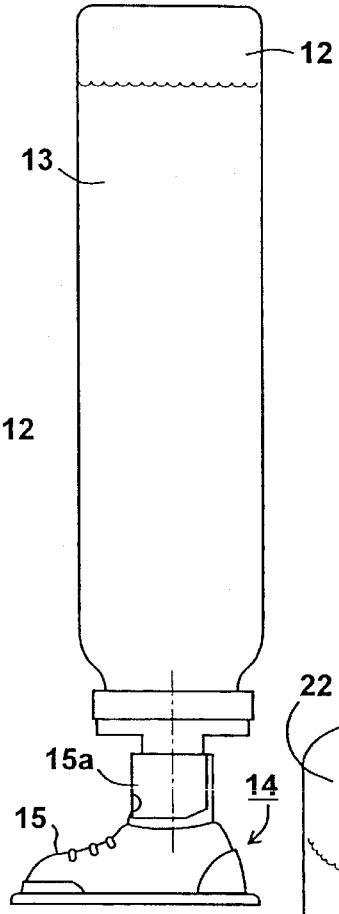

FIGS. 3–5 illustrate another deodorizer device constructed in accordance with the invention, comprising a container 12 for containing a quantity of liquid deodorizer material 13, and a dispenser assembly 14 attached to the container 12 so as to be at the bottom of the container. Dispenser assembly 14 includes an actuator cap 15 which is also engagable with the inner surface of the bottom of the shoe for dispensing the deodorizer material 13, and a feed tube 16 leading into the interior of container 12. In this case, however, feed tube 16 is integrally formed with a u-shaped extension 16*a* (FIG. 4) such that the open end 16*b* of the feed tube 16 is at the bottom of container 12 when in its inverted position to enable the container to dispense substantially all its contents when in the inverted position.

In the modification illustrated in FIGS. 3 and 4, only a single discharge opening 18 is formed in feed tube 16. In addition, the actuator cap 15 is in the form of a shoe. Thus, one end of the cap 15 is formed with a socket 15*a* coaxial with and dimensioned for receiving the external end of feed tube 6, and with a slot 15*b* for exposing the discharge opening 18 in the feed tube. The opposite bottom end 15*c* of actuator cap 15 is formed with an enlarged surface area for engaging the upper surface of the bottom of the shoe (10, FIG. 2), when the deodorizer device is inserted in inverted position within the shoe as shown in FIG. 2.

The bottom end 15*c* of the actuator cap 15 is preferably of sufficiently large surface so as to enable the container 12 to be stably supported in inverted position in the shoe such that, whenever a quantity of deodorizer material is to be dispensed, the user may merely press the opposite end of container 13 downwardly to discharge a quantity of the deodorizent material from discharge opening 18. Discharge opening 18 is oriented to direct the discharged deodorizer material towards the tip of the shoe cap 15, and of the shoe being deodorized (10, FIG. 2).

In all other respects, the deodorizer device illustrated in FIGS. 3–5 is constructed, and is used in the same manner, as described above with respect to FIGS. 1 and 2.

Figure 6:
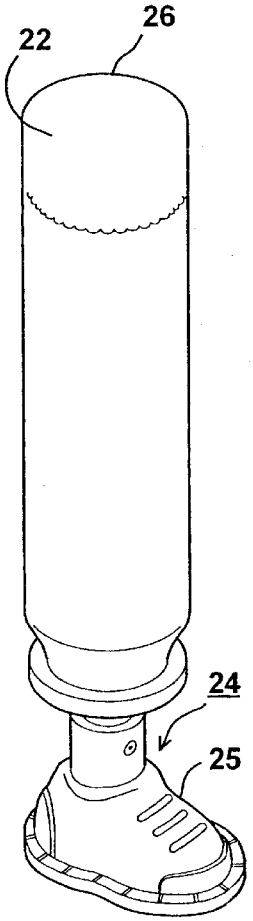
FIG. 6 is a perspective view illustrating a further deodorizer device constructed in accordance with the present invention.

FIG. 6 illustrates a further construction similar to that of FIGS. 3–5, except that the actuator cap 25, also in the shape of a shoe for stably resting the container 22 in an inverted vertical position, is built into the dispenser assembly 24, rather than being constructed as a separate cap applied to the container. Another modification is that the opposite end of the container 26 is of a dome-shaped configuration, which precludes supporting the container from that end. This construction thereby directs the user to apply the container in its inverted position. It also facilitates pressing the container downwardly, while stably resting in its inverted position within the shoe, to discharge a quantity of the deodorizer material into the shoe.

While the invention has been described with respect to two preferred embodiments, it will be appreciated that these are set forth merely for purposes of example, and that many other variations, modifications and applications of the invention may be made.

What is claimed is:

1. A device for deodorizing shoes, comprising:

a container containing a deodorizer material;

and a dispenser assembly at one dispensing end of the container for dispensing the deodorizer material therefrom;

said dispenser assembly including a feed tube having an inner region with one open end located within the container and an outer region with an opposite, dispensing end communicating with at least one discharge opening external of the container for discharging the deodorizer material laterally of the container;

said dispenser assembly further including an actuator attached at one end to said feed tube;

said actuator being in the form of a cap having a socket at a connecting end coaxial with, and dimensioned to receive said dispensing end of the feed tube and including a cylindrical wall formed with a slot for exposing the discharge opening with which the dispensing end of the feed tube communicates, the opposite, supporting end of said cap being dimensioned and configured to enable the container to stably rest in the inverted position within the shoe with said dispensing end of the container and said dispenser assembly disposed within the shoe, and the opposite end of the container extending outwardly of the shoe, to enable a quantity of the deodorizer material to be dispensed into the shoe by pressing against said opposite end of the container, wherein the deodorizer material is a liquid and the container additionally contains a pressurized gas, wherein the inner portion of said feed tube is integrally formed with a u-shaped extension such that the open end of the feed tube is near the dispensing end of the container, thereby enabling dispensation of substantially all of the deodorizer material when the container is inverted, wherein the dispenser assembly comprises an internal 360° dispensing valve capable of dispensing the deodorizer material when the container is inverted and which remains in a closed position until the actuator is pressed against the inner surface of a shoe bottom, and wherein the discharge opening is oriented to discharge the deodorizer material towards a shoe tip.

2. A method of deodorizing shoes, comprising:

providing a deodorizer device according to claim 1, inserting said deodorizer device into a shoe, with the container in an inverted position such that the dispensing end of the container is lower than the opposite end;

stably resting the container in this inverted position on the inner surface of the shoe bottom; and applying downward pressure to the opposite end of the container sufficient for discharging a quantity of deodorizer material into the shoe.

3. A device for deodorizing shoes, comprising:

a container containing a deodorizer material;

and a dispenser assembly at one dispensing end of the container for dispensing the deodorizer material therefrom;

said dispenser assembly including a feed tube having an inner region with one open end located within the container and an outer region with an opposite, dispensing end communicating with at least one discharge opening external of the container for discharging the deodorizer material laterally of the container;

said dispenser assembly further including an actuator attached at one end to said feed tube;

said actuator being in the form of a cap having a socket at a connecting end coaxial with, and dimensioned to receive said dispensing end of the feed tube and including a cylindrical wall formed with a slot for exposing the discharge opening with which the dispensing end of the feed tube communicates, the opposite, supporting end of said cap being dimensioned and configured to enable the container to stably rest in the inverted position within the shoe with said dispensing end of the container and said dispenser assembly disposed within the shoe, and the opposite end of the container extending outwardly of the shoe, to enable a quantity of the deodorizer material to be dispensed into the shoe by pressing against said opposite end of the container, wherein the deodorizer material is an unpressurized liquid or powder and the dispenser assembly comprises a manual pump which is pumped by the actuator when the actuator is pressed against the inner surface of a shoe bottom.

4. The deodorizer device according to claim 3, wherein the discharge opening is oriented to discharge the deodorizer material towards a shoe tip.

5. The deodorizer device of claim 3, wherein the dispenser assembly comprises multiple discharge openings around the circumference of the dispenser assembly.

6. A method of deodorizing shoes, comprising:

providing a deodorizer device according to claim 3, inserting said deodorizer device into a shoe, with the container in an inverted position such that the dispensing end of the container is lower than the opposite end;

stably resting the container in this inverted position on the inner surface of the shoe bottom; and applying downward pressure to the opposite end of the container sufficient for discharging a quantity of deodorizer material into the shoe.

7. The method of claim 6, wherein the dispenser assembly includes a single discharge opening oriented to discharge the deodorizer material towards the tip of the shoe.

8. The method of claim 6, wherein the dispenser assembly includes multiple discharge openings arranged around the circumference of the dispenser assembly to allow discharge of the deodorizer material in multiple directions within the shoe.

9. A device for deodorizing shoes, comprising:

a container containing a deodorizer material;

and a dispenser assembly at one dispensing end of the container for dispensing the deodorizer material therefrom;

said dispenser assembly including a feed tube having an inner region with one open end located within the container and an outer region with an opposite, dispensing end communicating with at least one discharge opening external of the container for discharging the deodorizer material laterally of the container;

said dispenser assembly further including an actuator attached at one end to said feed tube;

said actuator being in the form of a cap having a socket at a connecting end coaxial with, and dimensioned to receive said dispensing end of the feed tube and including a cylindrical wall formed with a slot for exposing the discharge opening with which the dispensing end of the feed tube communicates, the opposite, supporting end of said cap being dimensioned and configured to enable the container to stably rest in the inverted position within the shoe with said dispensing end of the container and said dispenser assembly disposed within the shoe, and the opposite end of the container extending outwardly of the shoe, to enable a quantity of the deodorizer material to be dispensed into the shoe by pressing against said opposite end of the container, wherein the deodorizer material is a liquid and the container additionally contains a pressurized gas, wherein the inner portion of said feed tube is integrally formed with a u-shaped extension such that the open end of the feed tube is near the dispensing end of the container, thereby enabling dispensation of substantially all of the deodorizer material when the container is inverted, wherein the dispenser assembly comprises as internal 360° dispensing valve capable of dispensing the deodorizer material when the container is inverted and which remains in a closed position until the actuator is pressed against the inner surface of a shoe bottom, and wherein the dispenser assembly comprises multiple discharge openings around the circumference of the dispenser assembly.

10. A method of deodorizing shoes, comprising:

providing a deodorizer device according to claim 9;

inserting said deodorizer device into a shoe, with the container in an inverted position such that the dispensing end of the container is lower than the opposite end;

stably resting the container in this inverted position on the inner surface of the shoe bottom; and applying downward pressure to the opposite end of the container sufficient for discharging a quantity of deodorizer material into the shoe.

11. The deodorizer device of one of claims 1, 3, or 9, wherein the actuator is of a generally conical shape with the circumference of the supporting end of the actuator being greater than the circumference of the connecting end.

12. The deodorizer device according to one of claims 1, 3, or 9, wherein the cap is in the configuration of a shoe.

13. The deodorizer device according to one of claims 1, 3, or 9, wherein the end of the container opposite the dispensing end is of a done configuration.

14. The deodorizer device according to one of claims 1, 3, or 9, wherein the deodorizer material is a liquid comprising 70% ethanol, 23% water, 3.2% preventol R80,2% NP10, 1% orange terpenes, 0.5% pine oil, 0.15% perfume, 0.1% citric acid, and 0.05% EDTA.

15. The method of one of claims 2, 6, or 10, wherein the actuator cap has the configuration of a shoe.

16. The method of one of claims 2, 6, or 10, wherein the end of the container opposite the dispensing end is of a dome configuration.

* * * * *